US009790726B2

(12) United States Patent
Balbo di Vinadio

(10) Patent No.: US 9,790,726 B2
(45) Date of Patent: Oct. 17, 2017

(54) DEVICE FOR OPENING AND CLOSING AN OUTWARDLY OPENING PIVOTING WING

(71) Applicant: SAVIO S.p.A., Chiusa San Michele (IT)

(72) Inventor: Aimone Balbo di Vinadio, Chiusa San Michele (IT)

(73) Assignee: SAVIO S.P.A., Chiusa San Michele (Turin) (IT)

( * ) Notice: Subject to any disclaimer, the term of this patent is extended or adjusted under 35 U.S.C. 154(b) by 0 days.

(21) Appl. No.: 15/194,124

(22) Filed: Jun. 27, 2016

(65) Prior Publication Data

US 2017/0016263 A1 Jan. 19, 2017

(30) Foreign Application Priority Data

Jul. 14, 2015 (IT) ..... 102015000034055

(51) Int. Cl.
*E05F 11/14* (2006.01)
*E06B 3/36* (2006.01)
(Continued)

(52) U.S. Cl.
CPC ..... *E05F 11/16* (2013.01); *E05F 11/14* (2013.01); *E05F 11/34* (2013.01); *E06B 3/36* (2013.01);
(Continued)

(58) Field of Classification Search
CPC . E05F 11/10; E05F 11/14; E05F 11/16; E05F 11/24; E05C 9/24; E05C 9/063;
(Continued)

(56) References Cited

U.S. PATENT DOCUMENTS 2,114,645 A 4/1938 Benschoten
4,679,352 A * 7/1987 Bates ..... E05D 15/30 49/192
(Continued)

FOREIGN PATENT DOCUMENTS

DE GB2153005 8/1985
DE GB2320520 6/1998

OTHER PUBLICATIONS

Italian Search Report and Written Opinion dated Mar. 16, 2016 for Application No. IT UB20152156.

*Primary Examiner* — Justin Rephann
(74) *Attorney, Agent, or Firm* — Patterson & Sheridan, L.L.P.

(57) ABSTRACT

A device for opening and closing an outwardly opening pivoting wing, comprising: an actuating device including a support, a crank rotatable with respect to the support and a control mechanism actuated by the crank, an arm having a toothed portion, wherein said control mechanism cooperates with the toothed portion of the arm for swinging the arm between a closed wing angular position and an open wing angular position, and wherein in the closed wing angular position the control mechanism cooperates with the toothed portion of the arm for the translational motion of the arm along a straight direction between a locked wing position and an unlocked wing position, and vice versa, a first slider and a second slider intended to engage a groove of the wing in a movable manner in a straight direction.

7 Claims, 9 Drawing Sheets

(51) Int. Cl.
*E05F 11/16* (2006.01)
*E05F 11/34* (2006.01)

(52) U.S. Cl.
CPC ..... *E05Y 2201/22* (2013.01); *E05Y 2201/484* (2013.01); *E05Y 2201/71* (2013.01); *E05Y 2900/148* (2013.01)

(58) Field of Classification Search
CPC ..... E05C 9/185; E05C 9/1808; E05C 9/16; E05C 9/1833; E05Y 2900/148
See application file for complete search history.

(56) References Cited

U.S. PATENT DOCUMENTS 5,636,476 A * 6/1997 Eikmeier ..... E05F 11/16 49/246
6,122,863 A * 9/2000 Tippin ..... E05F 11/16 49/279
6,135,511 A * 10/2000 Smith ..... E05C 9/063 292/139
7,396,054 B2 * 7/2008 Carrier ..... E05B 17/0025 292/302
9,518,416 B2 * 12/2016 Pacini ..... E05F 11/24
2005/0016073 A1 * 1/2005 Petta ..... E05C 9/02 49/504
2010/0101148 A1 * 4/2010 Carrier ..... E05F 11/16 49/346
2011/0078956 A1 * 4/2011 Lambertini ..... E05C 9/24 49/221
2012/0174487 A1 * 7/2012 Lambertini ..... E05F 11/16 49/353
2013/0025207 A1 * 1/2013 Lambertini ..... E05C 9/063 49/300
2015/0013230 A1 * 1/2015 Balbo Di Vinadio .. E05D 15/44 49/359
2016/0130847 A1 * 5/2016 Gramstad ..... E05C 9/1833 49/394

* cited by examiner

DEVICE FOR OPENING AND CLOSING AN OUTWARDLY OPENING PIVOTING WING

CROSS-REFERENCE TO RELATED APPLICATIONS

This application claims benefit of Italian patent application number 102015000034055, filed Jul. 14, 2015, which is herein incorporated by reference.

BACKGROUND OF THE INVENTION

Field of the Invention

The present invention relates to accessories for doors and windows and regards a control assembly for an outwardly opening pivoting wing.

The invention can be applied to wings articulated about vertical axes or to wings articulated about horizontal axes.

Description of Prior Art

Devices are known for opening and closing an outwardly opening pivoting wing comprising:

an actuating device including a crank associated with a worm screw and a rotatable gear, actuated into rotation by said worm screw; and an arm, pivoting about a fixed pin and having a toothed portion that meshes with said gear, wherein said gear cooperates with the toothed portion to swing the arm between a closed wing angular position and an open wing angular position.

The openable wings are normally equipped with a locking device to lock the wing in the closed position. In the known solutions, the locking/unlocking device of the wing is separate and independent from the opening/closing device of the wing. The locking device can, for example, be controlled by a cremone handle or by any other known type of device. Therefore, two independent maneuvers for controlling the locking/unlocking of the wing and the opening/closing movement are necessary.

U.S. Pat. No. 2,114,645 describes a device for opening and closing a pivoting wing equipped with a crank-operated device, which also controls the locking and unlocking of the wing. The device described in U.S. Pat. No. 2,114,645 comprises:

an actuating device including a support, a crank rotatable with respect to the support and a control mechanism actuated by the crank; and an arm having a toothed portion that cooperates with said control mechanism, wherein the control mechanism cooperates with the toothed portion of the arm for swinging the arm between a closed wing angular position and an open wing angular position, and wherein in the closed wing angular position, the control mechanism cooperates with the toothed portion of the arm for the translational motion of the arm along a straight direction between a locked wing position and an unlocked wing position, and vice versa.

The arm of the device described in U.S. Pat. No. 2,114,645 is connected to a wing locking/unlocking device by means of a pivoting lever, which acts as a corner drive. In the more recent control assemblies, the corner drive is formed by an L-shaped support, which carries a flexible lamina that connects movable elements to each other, located on orthogonal sides of the wing. One of the problems of the solution according to U.S. Pat. No. 2,114,645 is that this solution cannot be used with more recent corner drives.

SUMMARY OF THE INVENTION

The present invention aims to provide a device for opening and closing a pivoting wing that also controls the locking and unlocking of the wing, which solves the problems of the prior art.

According to the present invention, this object is achieved by a device having the characteristics forming the subject of claim 1.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

DETAILED DESCRIPTION

Figure 1:
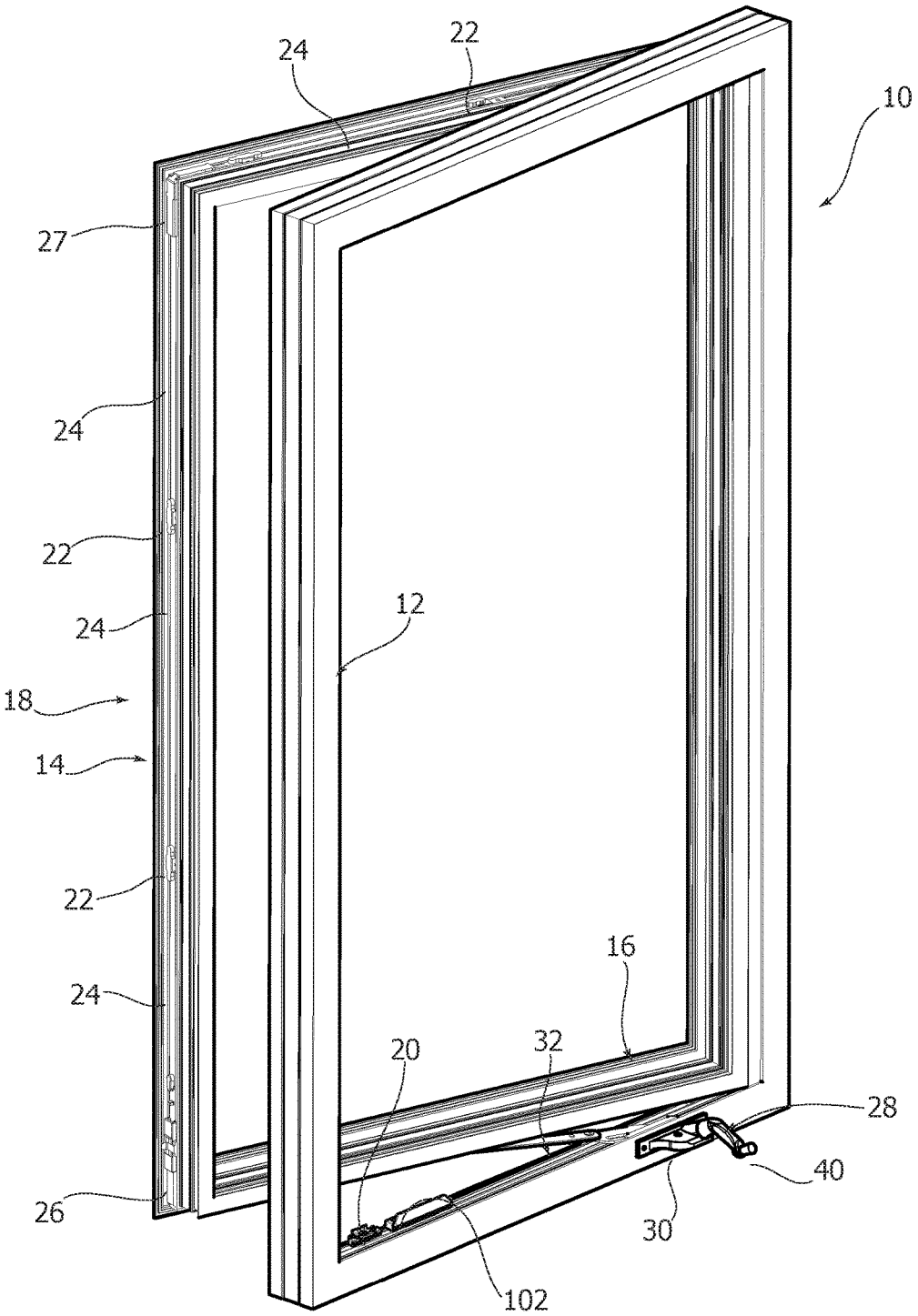
FIG. 1 is a perspective view of a wing provided with an opening and closing device according to the present invention, in an open position.

With reference to FIG. 1, numeral 10 indicates a window including a fixed frame 12 and a wing 14, articulated to the fixed frame 12 about a vertical axis, and outwardly opening.

Figure 2:
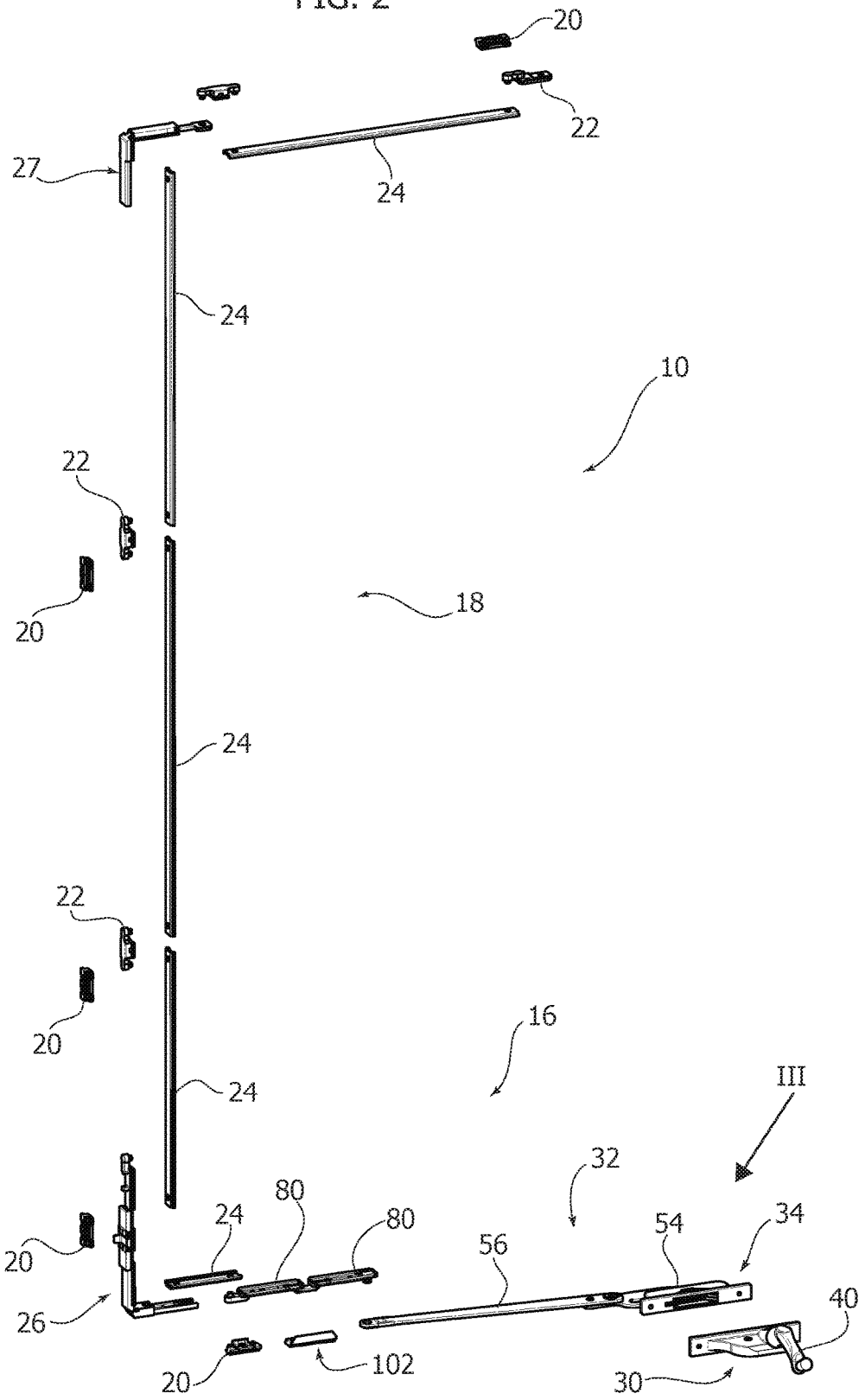
FIG. 2 is an exploded perspective view illustrating an opening/closing device according to the present invention, together with a locking device.

With reference to FIGS. 1 and 2, the window 10 comprises a control assembly including an opening/closing device 16 and a locking device 18. The opening/closing device 16 is intended to be mounted on the fixed frame 12, for example, on the lower horizontal side of the frame 12.

The locking device 18 comprises a plurality of strikers 20 fixed to the frame 12 along the lower horizontal side, the upper horizontal side and along the vertical side opposite to the articulation axis. The locking device 18 comprises a plurality of locking elements 22 cooperating with respective strikers 20. The locking elements 22 are carried by the wing 14 in a sliding manner in the longitudinal direction of the respective side of the wing. The locking elements 22 are preferably located on the lower horizontal side, on the upper horizontal side and the vertical side of the wing 14 opposite to the articulation axis. The locking elements 22 are movable with respect to the wing 14 between an unlocked position and a locked position. In the locked position, the locking elements 22 are facing respective strikers 20, so as to prevent the opening of the wing 14. In the unlocked position, the locking elements 22 are disengaged from the strikers 20, so as not to prevent opening of the wing 14.

The locking elements 22 are connected together by means of connecting rods 24 that are movable with respect to the wing 14 along respective longitudinal directions. The locking device 18 further comprises a lower corner drive 26 and an upper corner drive 27, which connect together the connecting rods 24 and the locking elements 22 located along sides of the wing 14 orthogonal to each other.

Figure 3:
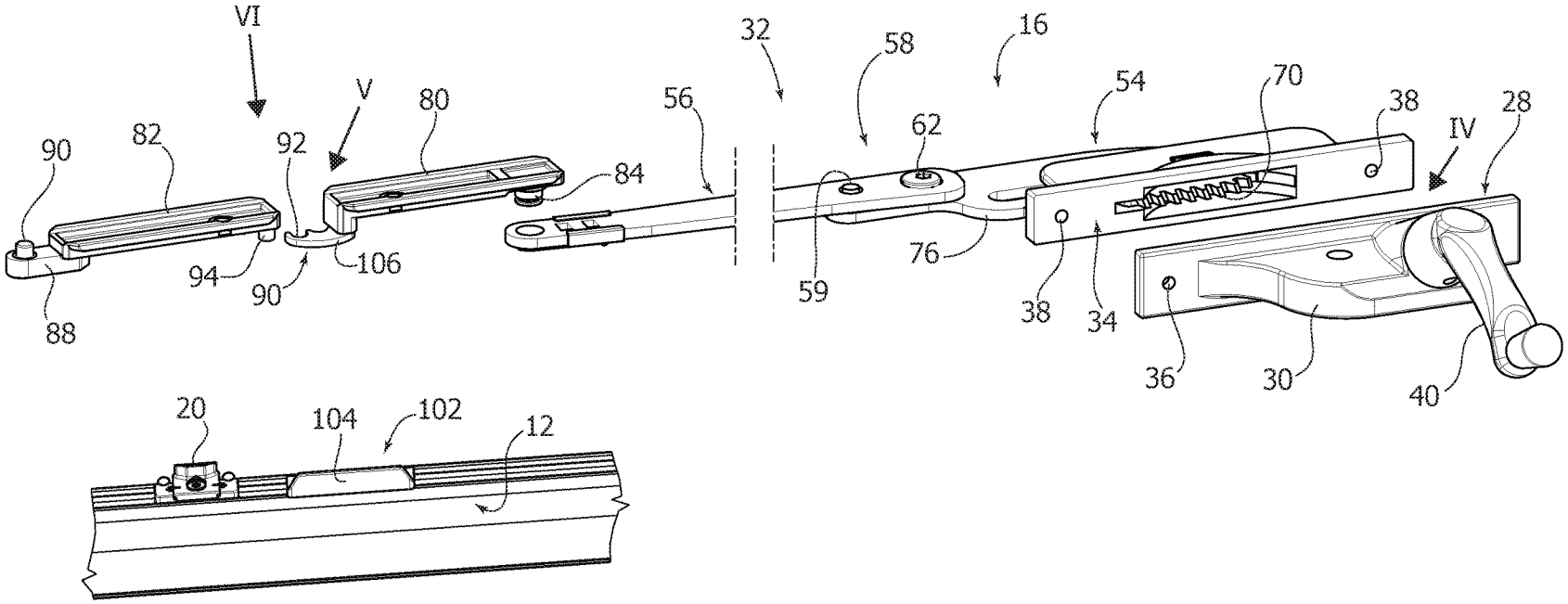
FIG. 3 is a perspective view on an enlarged scale of the opening/closing device indicated by the arrow III in FIG. 2.

With reference to FIG. 3, the opening/closing device 16 comprises a crank-operated device 28 intended to be fixed to the fixed frame 12. The crank-operated device 28 includes a first support 30 and a second support 34. The first support 30 carries a rotatable crank 40. The second support 34 carries an arm 32, which is capable of swinging and moving with respect to the second support 34. The first and the second supports 30, 34 are intended to be fixed on opposite faces of the same wall of the fixed frame 12. The first and the second supports 30, 34 are provided with holes 36, 38 aligned with each other and designed to be engaged by fastening screws (not shown). Alternatively, a single support could be provided that carries out the function of the first and the second supports 30, 34.

Figure 4:
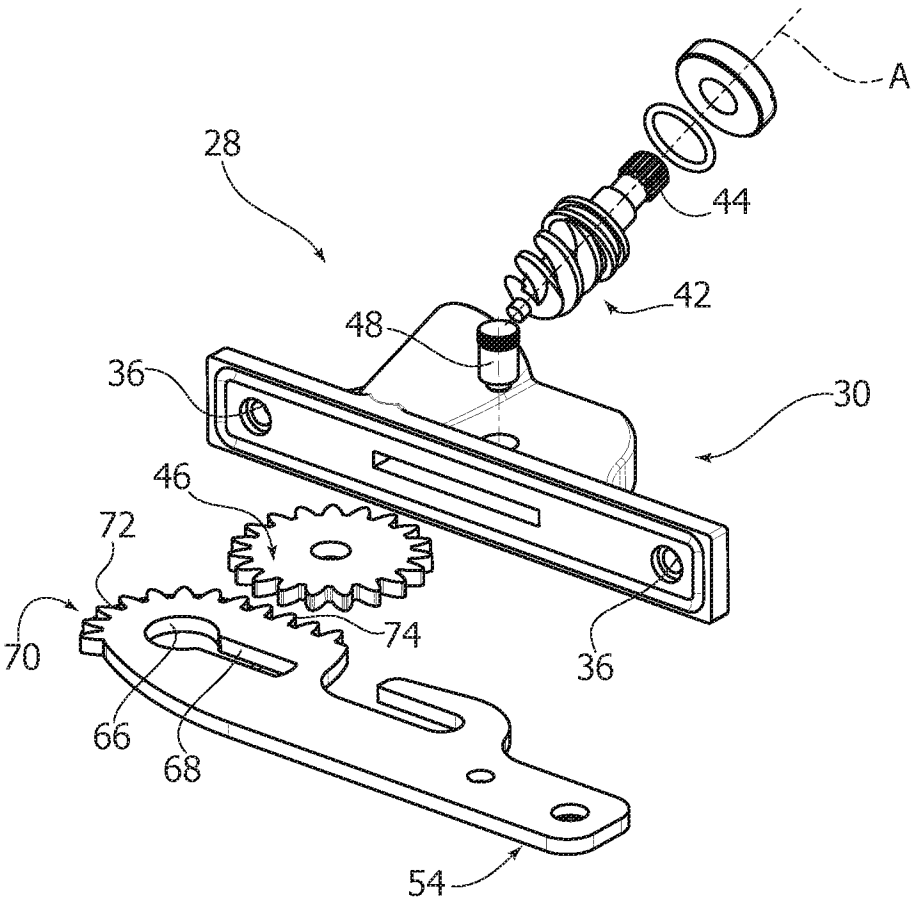
FIG. 4 is an exploded perspective view of the part indicated by the arrow IV in FIG. 3.

With reference to FIG. 4, the actuating device 28 comprises a worm screw 42, rotatable with respect to the first support 30 about an axis A coinciding with the rotation axis of the crank 40. The crank 40 is fixed to one end 44 of the worm screw 42. The actuating device 28 comprises a gear 46 rotatably mounted with respect to the first support 30 about a fixed pin 48. The gear 46 meshes with the worm screw 42 and is driven into rotation about the pin 48 by the crank 40.

With reference to FIG. 3, the arm 32 comprises a first arm section 54 and a second arm section 56 fixed together by means of an adjusting device 58 that allows adjustment of the angular position of the second arm portion 56 with respect to the first arm portion 54. The adjusting device 58 comprises a first pin 59, which engages two aligned holes and connects the first and the second arm portions 54, 56 together in an articulated manner. The adjusting device 58 also comprises a second pin 62, which engages a hole of the first arm section 54, in a rotatable manner. The second pin 62 has an eccentric portion, which engages a slot of the second arm section 56. An angular movement of the second pin 62 about its own axis varies the angular position of the second arm section 56 with respect to the first arm section 54. Once the adjustment is made, the two arm sections 54, 56 are fixed to each other in the selected position.

With reference to FIG. 4, the first arm section 54 is connected to the first support 30 by means of a mechanism that allows the arm 32 to pivot about an axis between a closed wing position and an open wing position, and vice versa, and that, in the closed wing position, allows the arm 32 to move in a straight direction with respect to the support 30 between a locked wing position and an unlocked wing position, and vice versa. A mechanism of this type is described in detail in the Italian patent application TO2014A000230. This mechanism comprises an articulation seat 66 formed in the first arm section 54. The articulation seat 66 has a circular profile that communicates with a straight guide 68, radial with respect to the center of the articulation seat 66. The articulation seat 66 has a circular profile, interrupted at the straight guide 68. The straight guide 68 has two straight parallel walls that define a straight opening that leads into the articulation seat 66. The articulation seat 66 is engaged by a pin with a rectangular cross-section carried by the second support 34.

The first arm section 54 has a toothed portion 70 composed of a circular toothed portion 72 and a straight toothed portion 74. The teeth of the toothed portion 70 extend continuously and with constant pitch along the circular toothed portion 72 and along the straight toothed portion 74. In the embodiment illustrated, the circular toothed portion 72 is coaxial with the articulation seat 66 and the straight toothed portion 74 is parallel to the straight guide 68.

The gear 46 meshes with the toothed portion 70 of the first arm section 54. When the gear 46 meshes with the straight toothed portion 74, the rotation of the crank 40 controls a movement in the straight direction of the arm 32. When the gear 46 meshes with the circular toothed portion 72, the rotation of the crank 40 controls a swinging of the arm 32 about a fixed axis.

With reference to FIGS. 3 and 6-9, the opening/closing device 16 comprises a first slider 80 and a second slider 82, intended to be slidably mounted within a longitudinal groove of the lower horizontal side of the wing 14. The first slider 80 is articulated to the distal end of the arm 32 by a pin 84.

The second slider 82 is connected to a connecting rod 24, which is, in turn, connected to the lower corner drive 26 of the locking device 18. The second slider 82 carries a closing element 88, which is intended to cooperate with a respective striker 20 fixed to the frame 12. Preferably, the closing element 88 is integrally formed with the second slider 82. The closing element 88 is preferably provided with a pin 90, which engages a corresponding hole of a connecting rod 24.

The first slider 80 and the second slider 82 are connected together in a releasable manner by means of a hook 90 articulated to the slider 80. The hook 90 has a seat 92, which engages—in a releasable manner—a pin 94 fixed to the other of the two sliders 80, 82. The seat 92 of the hook 90 is essentially U-shaped and is outwardly open, that is, towards the opening direction of the wing 14.

Figure 5:
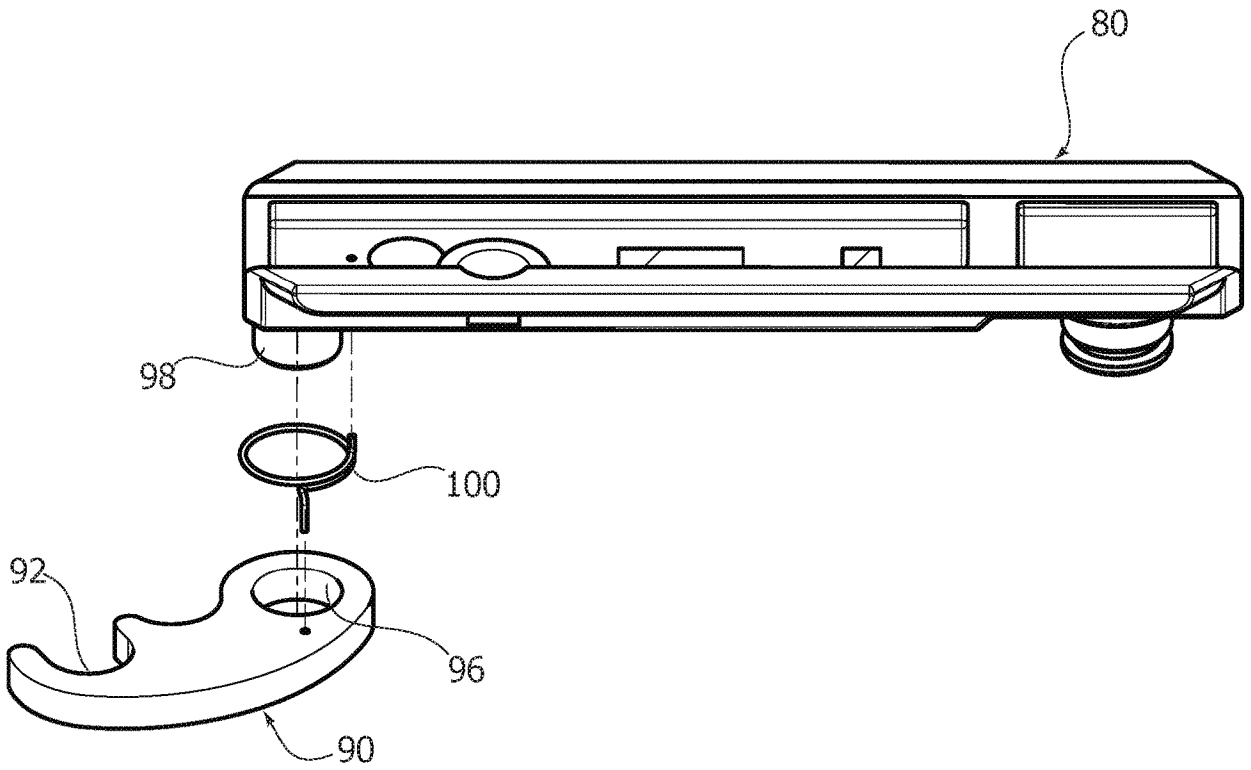
FIG. 5 is a partially exploded perspective view of the part indicated by the arrow V in FIG. 3.

With reference to FIG. 5, the hook 90 has a hole 96, which rotatably engages a pin 98 fixed to the first slider 80. The hook 90 is rotatable about the pin 98 between an engaged position and a disengaged position. An elastic element 100 formed, for example, of a torsion spring, tends to elastically push the hook 90 towards the disengaged position.

With reference to FIGS. 3 and 6-9, the opening/closing device 16 comprises a striker 102 intended to be fixed to the fixed frame 12. The striker 102 has an abutment wall 104 adjacent to the inner face of the frame 12 and which projects from the frame 12 towards the inside of the window opening.

When the arm 32 is in the closed wing position, an inner surface 106 of the hook 90 comes into contact against the abutment wall 104 of the striker 102. The striker 102, in the closed wing position, pushes the hook 90 into the engaged position. When the hook 90 moves away from the striker 102 following the swinging of the arm 32 towards the open wing position, the hook 90 moves to the disengaged position under the action of the elastic element 100.

FIGS. 6-9 illustrate the operation of the opening/closing device 16.

Figure 6:
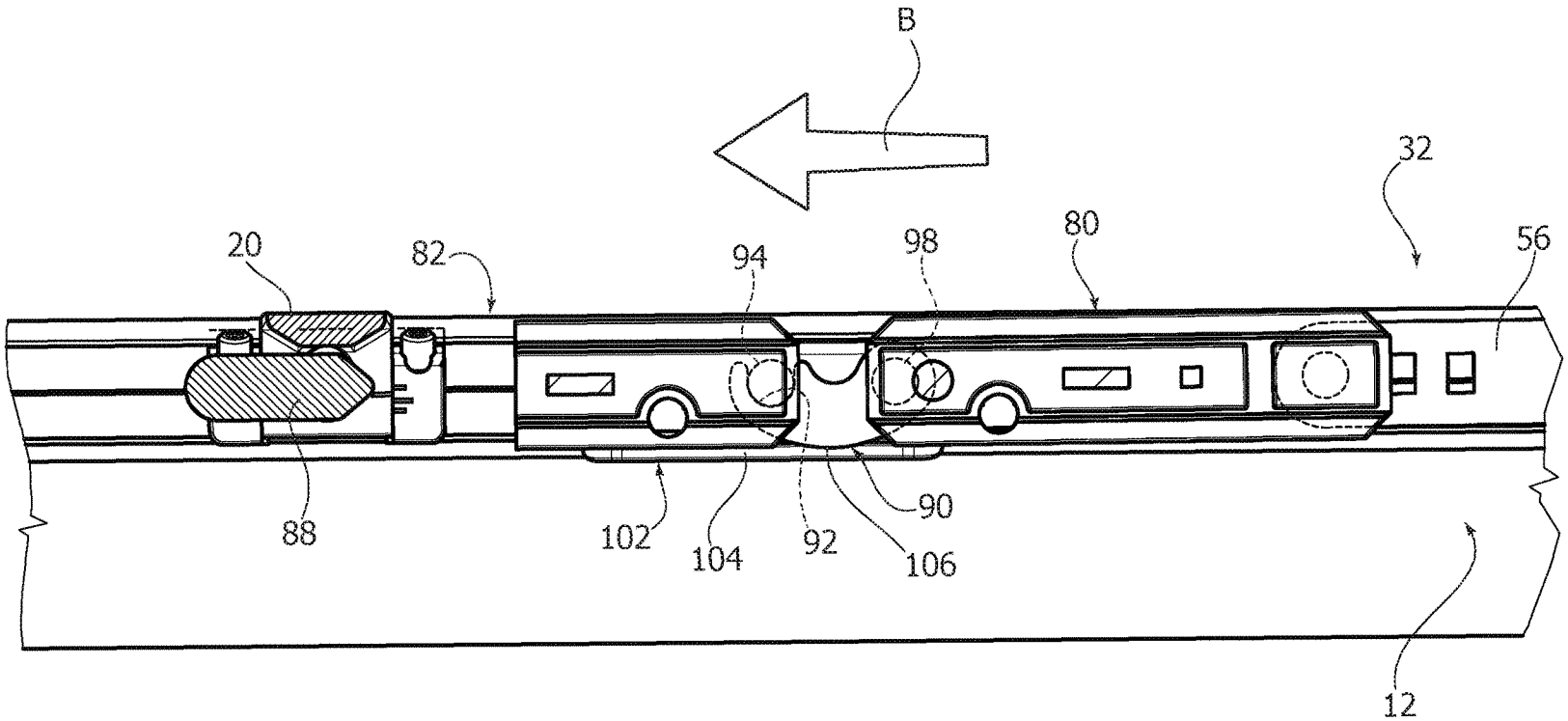
FIGS. 6-9 are plan views according to the arrow VI of FIG. 3 illustrating the sequence of operation of the device according to the present invention.

FIG. 6 shows the closed and locked condition of the wing 14. In this condition, the hook 90 rests against the wall 104 of the striker 102 and is kept in the engaged position. The seat 92 of the hook 90 engages the pin 94 of the second slider 82. In this condition, the first and the second sliders 80, 82 are connected to each other and are integrally movable in the unlocking direction indicated by the arrow B. In the closed and locked condition of the wing 14, the locking element 88 engages the corresponding striker 20. Furthermore, all the locking elements 22 distributed along three sides of the wing 14 engage the respective strikers 20 distributed along three sides of the frame 12.

In the closed and locked configuration of the wing 14, the gear 46 of the crank-operated device 28 engages with the straight toothed portion 74 of the arm 32. The rotation of the crank 40 controls a movement of the arm 32 in the straight direction B from the closed and locked wing position illustrated in FIG. 6 towards the closed and unlocked wing position illustrated in FIG. 7. The sliders 80, 82, being connected to each other by the hook 90, move in an integral manner from the closed and locked wing position towards the closed and unlocked wing position.

Figure 7:
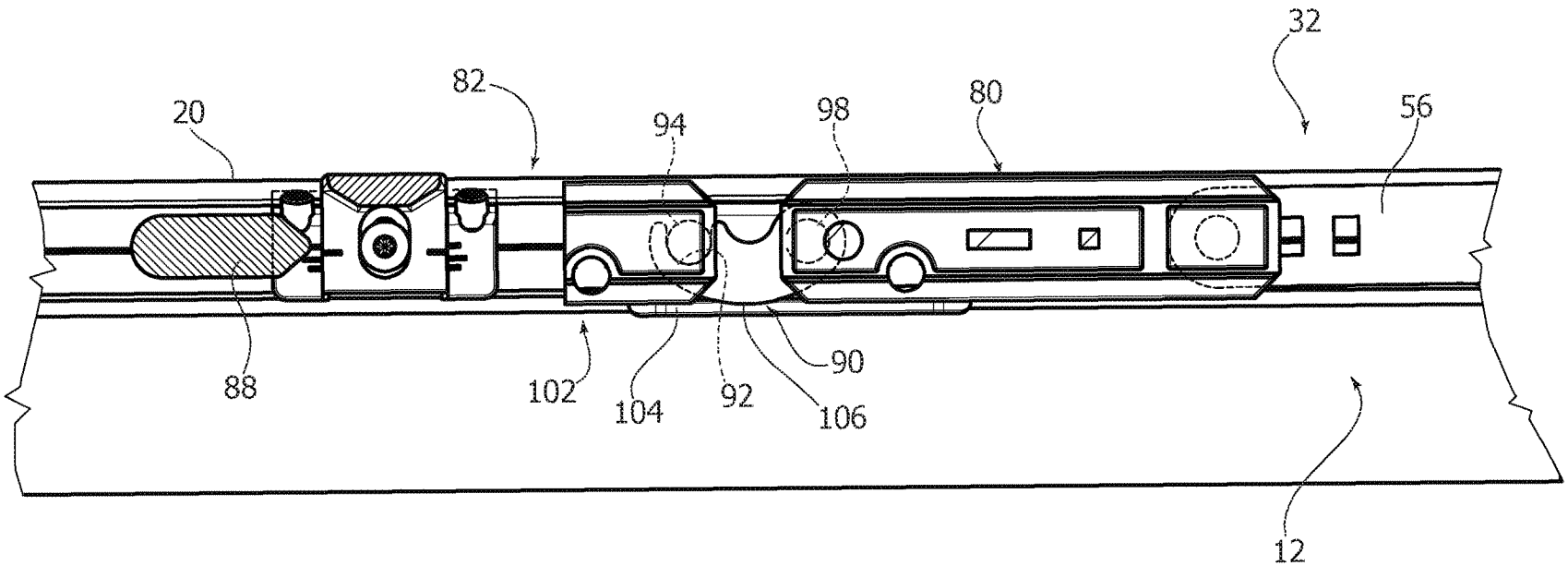

With reference to FIG. 7, in the closed and unlocked wing position, the hook 90 is still in contact with the wall 104 of the striker 102 and is held in the engaged position. The movement of the second slider 82 towards the closed and unlocked wing position disengages the locking element 88 from the respective striker 20. The second slider 82, being connected to the various locking elements 22 by means of the transmission rods 24 and the corner drives 26, 27, controls the disengagement of all the locking elements 22 from the respective strikers 20.

In the closed and unlocked wing position, the gear 46 meshes with the circular toothed portion of the teeth 72 of the arm 32. Continuing to rotate the crank 40, the arm swings from the closed position toward the open position in the direction indicated by the arrow C in FIG. 8.

Figure 8:
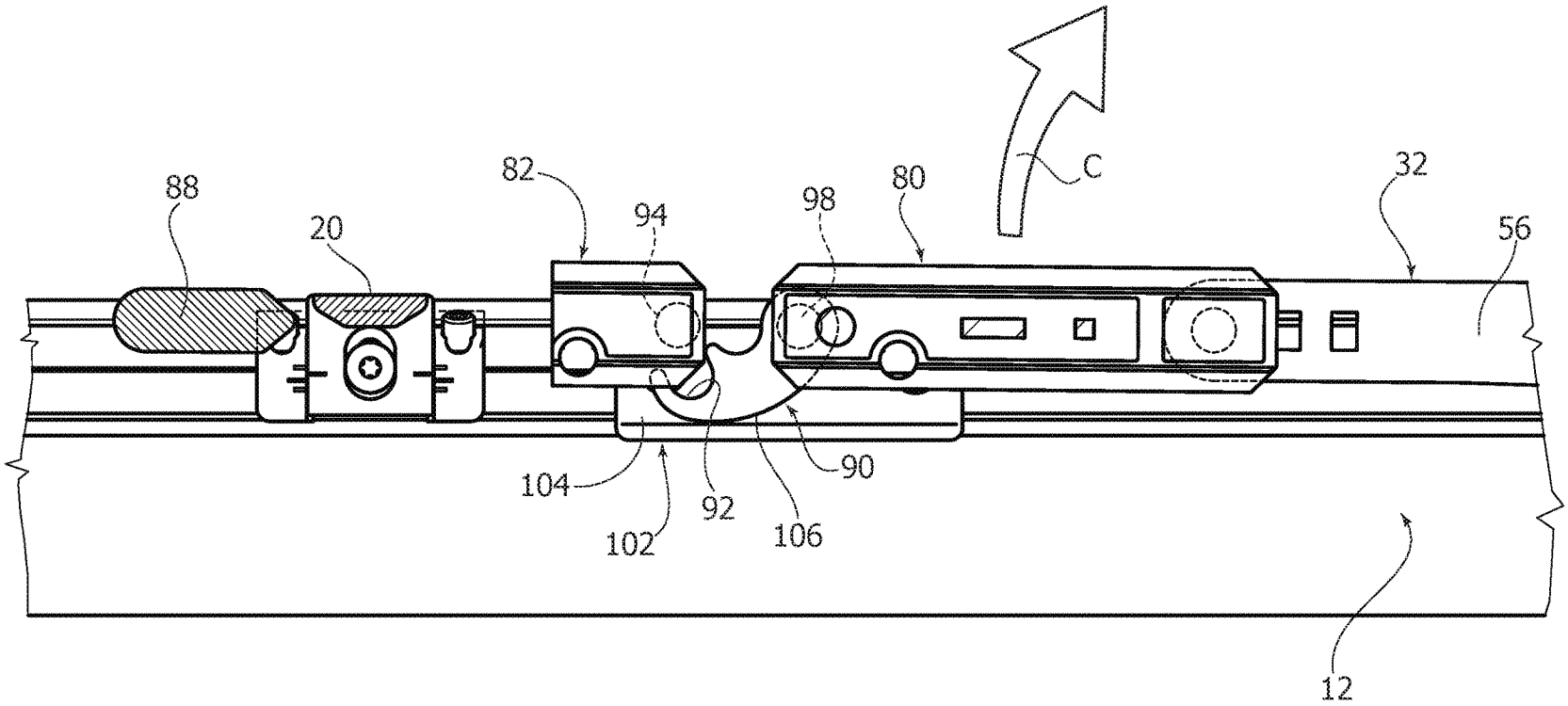
Figure 9:
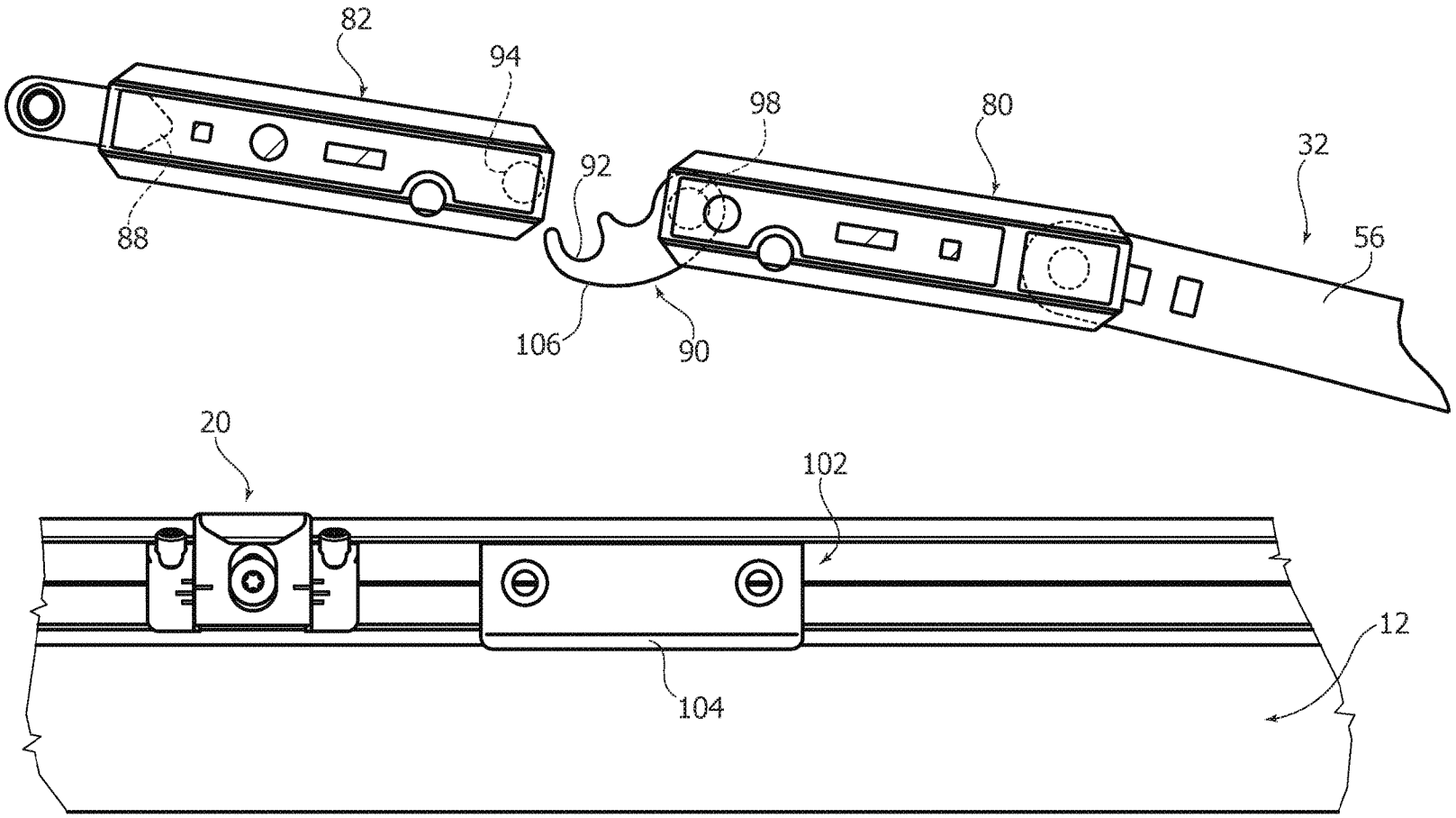

The swinging of the arm 32 in the direction C opens the wing 14 and moves the hook 90 away from the wall 104 of the striker 102. When the hook 90 moves away from the wall 104, it disengages from the pin 94 of the second slider 82, as shown in FIGS. 8 and 9.

In the open wing position, the second slider 82 is disengaged from the first slider 80. The rotation of the crank 40 controls the opening of the wing 14 by means of the arm 32 and the first slider 80. The second slider 82 and the locking elements 22 remain still during the opening movement of the wing.

During the closing movement, the previously described steps are followed in the opposite direction. When the hook 90 comes in contact with the wall 104 of the striker 102, it swings towards the engaged position and engages the pin 94 of the second slider 82. When the wing is in the closed position, the sliders 80, 82 are connected to each other by the hook 90 and the translational movement of the arm from the closed and unlocked wing position towards the closed and locked wing position controls the movement of all the locking elements 22 from the unlocked position towards the locked position.

The disengagement between the first and the second sliders 80, 82 allows the disengagement of the opening angle of the wing 14 from the stroke of the locking elements 22. In particular, it is possible to obtain an opening angle of the wing of 90° or above with a stroke of contained amplitude of the locking elements 22.

Of course, without prejudice to the principle of the invention, the details of construction and the embodiments can be widely varied with respect to those described and illustrated, without thereby departing from the scope of the invention as defined by the claims that follow.

The invention claimed is:

1. A device for opening and closing an outwardly opening pivoting wing, comprising:

an actuating device including a support, a crank rotatable with respect to the support and a control mechanism actuated by the crank;

an arm having a toothed portion, wherein said control mechanism cooperates with the toothed portion of the arm for swinging the arm between a closed wing angular position and an open wing angular position, and wherein in the closed wing angular position, the control mechanism cooperates with the toothed portion of the arm for translational motion of the arm between a locked wing position and an unlocked wing position; and vice versa, a first slider and a second slider for engagement with a groove of the wing in a movable manner, wherein the first slider is articulated to a distal end of said arm and the second slider is connectable to a locking device including a plurality of locking elements for mounting on the wing in a movable manner for connection together by a plurality of connecting rods; and a hook articulated to one of said first or second sliders, the hook having a seat intended to releasably engage a pin fixed to the other of said first or second sliders, wherein the hook is movable between an engaged position in which said seat engages said pin and the two sliders are integrally movable with each other and a disengaged position in which said seat is disengaged from said pin and the first and second sliders are disengaged from each other.

2. A device according to claim 1, wherein the hook is associated with an elastic element to keep the hook in said disengaged position.

3. A device according to claim 1, wherein in said closed wing position said hook is constructed and arranged to rest against a striker fixed with respect to a frame and which pushes said hook into said engaged position.

4. A device according to claim 3, wherein said striker has a stop wall adjacent to an inner face of the frame and projecting from the frame towards an inside of the window opening.

5. A device according to claim 1, wherein said seat of the hook has an outwardly open shape.

6. A device according to claim 1, wherein said second slider is connected to a corner drive via a connecting rod.

7. A device according to claim 1, wherein said second slider carries a closing element cooperating with a respective striker.

* * * * *